United States Patent [19]

Wahli

[11] 4,226,111

[45] Oct. 7, 1980

[54] METHOD AND APPARATUS FOR THE SURFACE WORKING AND FOR REWORKING OF WORKPIECES

[76] Inventor: Marcel Wahli, Glattalstrasse 844, Rümlang-Zürich, Switzerland

[21] Appl. No.: 949,984

[22] Filed: Oct. 10, 1978

[30] Foreign Application Priority Data

Oct. 11, 1977 [CH] Switzerland ..... 12386/77

[51] Int. Cl.[3] ..... B21J 5/00

[52] U.S. Cl. ..... 72/437; 72/53; 72/452; 73/37.8

[58] Field of Search ..... 72/53, 452, 476, 437, 72/433, 434; 73/37.5, 37.8

[56] References Cited

U.S. PATENT DOCUMENTS

| | | | |
|---|---|---|---|
| 2,486,844 | 11/1949 | Hercik | 72/DIG. 8 |
| 3,050,985 | 8/1962 | Roetter | 73/37.8 |
| 3,508,432 | 4/1970 | Marshall | 73/37.8 |

FOREIGN PATENT DOCUMENTS

| | | | |
|---|---|---|---|
| 26883 | 9/1902 | Switzerland | 72/452 |
| 27313 | 1/1903 | Switzerland | 72/452 |
| 130175 | 2/1929 | Switzerland | 72/437 |
| 17869 | 12/1915 | United Kingdom | 72/437 |

OTHER PUBLICATIONS

"Indentation Shaft Straightening" (Technical Disclosure Bulletin 6053) Central Electricity Generating Board, information services, Sudbury House, 15 Newgate St., London ECIA 7AU (Jun. 1975) 4 pp., Rowberry et al.

*Primary Examiner*—Francis S. Husar
*Assistant Examiner*—Gene P. Crosby
*Attorney, Agent, or Firm*—Blanchard, Flynn, Thiel, Boutell & Tanis

[57] ABSTRACT

Method and apparatus for the surface working and for reworking, or reshaping, of elongated workpieces. A strike bolt strikes the inner side of the curvature of the workpiece at high frequency to apply a plurality of strikes to the workpiece. Measurement of the straightening of the curved workpiece occurs directly on the worktable, preferably by means of air-jet nozzles, which are connected to indicating tubes.

8 Claims, 5 Drawing Figures

Fig.1
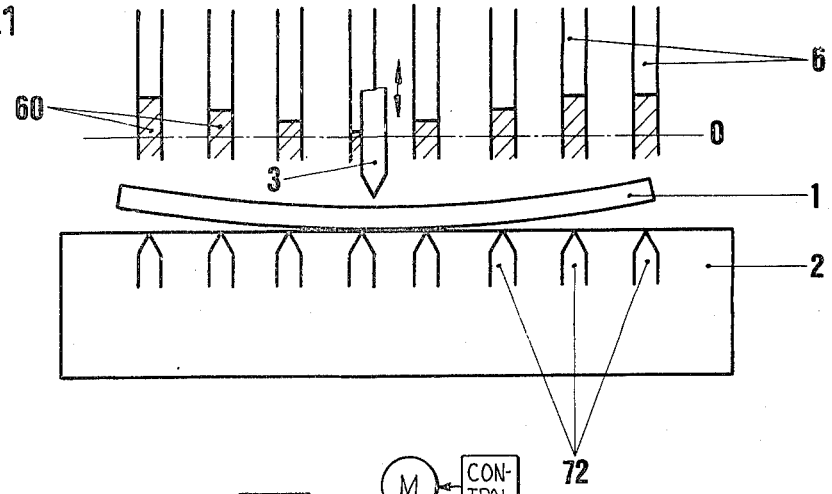
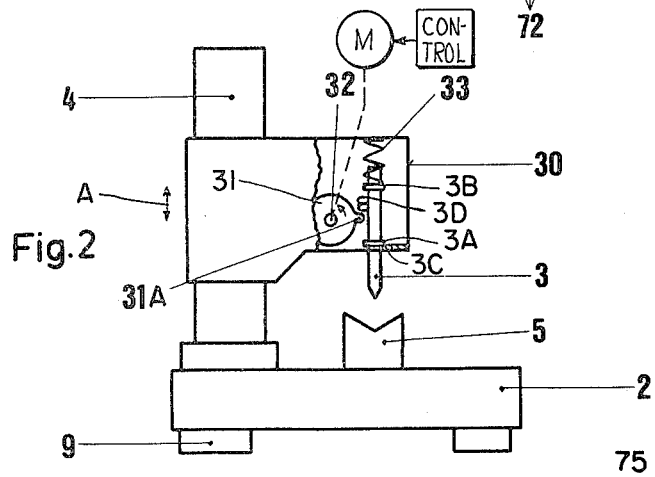
Fig.2
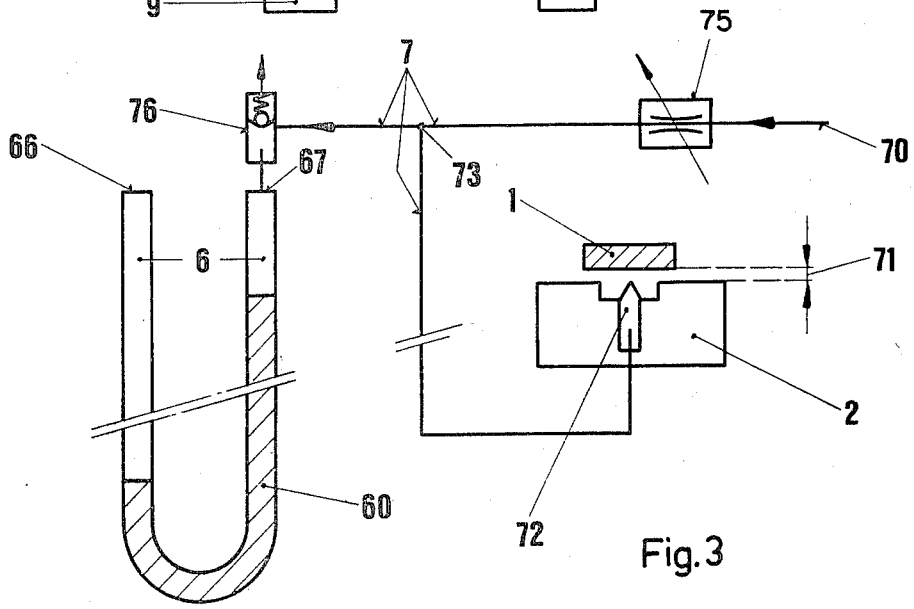
Fig.3

METHOD AND APPARATUS FOR THE SURFACE WORKING AND FOR REWORKING OF WORKPIECES

FIELD OF THE INVENTION

The invention relates to a method and an apparatus for surface working of workpieces for the purposes of increasing the surface hardness or for straightening of curved workpieces, like rods, plates, shafts, bars or the like of metal, like iron and tool steel, which have been bent due to internal stresses of the material or through mechanical, chip-removing working, for example milling, drilling, planing, grinding or through subsequent hardening operations so much that they could no longer be used for a further application.

BACKGROUND OF THE INVENTION

Reworking of these workpieces occurs mostly through a hammering of the workpieces by hand or through an overexpanding beyond the straightened position, so that the workpiece after springing back has the desired straightness. Such a hammering or overexpansion demands great skill and experience. Material destructions, for example breakage or tears, will occur due to excessive mechanical working. In addition, these operations are very difficult and the magnitude of waste can be very high.

Reworking can also be done by exposing the curved tool to a local heating up operation, which results in an expansion at said point. However, this heating up has the disadvantage, that the workpiece loses its hardness. Also this method of working is very difficult and only experienced workers achieve satisfactory results.

The purpose of the invention is to provide a reworking method and an apparatus to perform the method, which permits an economical surface working or reworking of a workpiece without influencing the material characteristics and nominal measurements.

Surprisingly it has been found that a grouping of high frequency strikes or blows directed with a strike bolt having a curved point against a workpiece surface, preferably distributed over the particular surface to be treated, results in the desired result.

For reworking, the strikes are applied to the inner side of the curvature.

To carry out this method, an apparatus is suitable, which is inventively characterized by a column, on which is movably and adjustably arranged a strike hammer device for applying a continuous grouping of strikes by means of a strike bolt having a curved point, and a rigid table for supporting the workpiece in the path of movement of the strike bolt.

It is preferable to construct the table which supports the workpiece directly as a measuring table, and an absolute measurement is not necessary. It is sufficient, to perform a comparison measurement, since the goal of the invention is to end up with a flat and rectilinear extent of the surface of the workpiece.

The table can therefore be flat, so that an inexactness can be recognized through a tilting of the workpiece or through an air gap.

As a comparison measuring device a flat plate is suitable, which is constructed with discharging air channels, these air channels being arranged in alignment and at equal distance, each air channel being under pneumatic pressure and is connected to an indicating device which indicates the pressure drop as a result of the exiting gas. Each air channel can be connected to each one U-shaped bent tube, which on its inside is filled partly with a preferably colored liquid and the one end of which is closed off air-tight and the other end of which is connected between the ends of a line from a gas source to the air channel.

The invention will be discussed more in detail with reference to the drawing, in which one exemplary embodiment of an apparatus for reworking and comparison measuring of a workpiece is shown.

BRIEF DESCRIPTION OF THE DRAWINGS

In the drawings:

FIG. 1 is a side view of a workpiece, which has not as yet been reworked and which lies on a table, with a measuring scale which is arranged therebehind.

FIG. 2 is a schematic side view of an apparatus for reworking of shafts, having a prism as support.

FIG. 3 is a schematic view of an air-gap measuring device.

DETAILED DESCRIPTION

Figure 4:
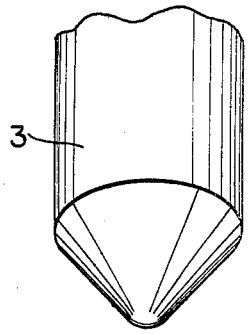
FIGS. 4 and 5 are enlarged pictorial views showing strike bolt tips of ball and circular-cylindrical shapes, respectively.

The elongated workpiece is identified by the reference numeral 1 in FIG. 1. The curvature of the workpiece, caused by a hardening process, has been exaggerated in the drawing for illustrative purposes. In actuality, the degree of curvature compared with the straightened condition of the workpiece is in the range of tenths of millimeters, for example 0 to 0.8 mm. for a 10 cm. long workpiece. This curvature can be determined by tilting the workpiece on a flat plate or a table 2, namely not as a nominal, or numerical, measurement of the curvature, but as a comparison test.

During a reworking of the workpiece, as is shown in the drawing, a strike bolt 3 of a strike hammer device 30 strikes the inner side of the curvature of the workpiece. A series of strikes of small to medium strength applied to the workpiece results in a straightening of the curved character of the workpiece.

The apparatus for carrying out the reworking method is illustrated in FIG. 2. The strike hammer device 30 with the strike bolt 3 is vertically adjustably mounted on an upstanding column 4, as indicated by the arrow A. A prism 5 is positioned on the table 2 and functions as a support for the workpiece. Any aggregate can be used as the strike hammer device, with which a continuous striking of the workpiece with a series of strikes is possible. The strike or blow can occur by means of the striking bolt 3 being reciprocally mounted in the strike hammer device. The strike bolt 3 has a pair of axially spaced collars 3A and 3B fixedly secured thereto. The lowermost collar 3A is urged into engagement with a stop 3C on the strike hammer device 30 by a compression spring 33, the stop 3C limiting the downward movement of the strike bolt 3. A protuberance 3D is provided on the strike bolt 3 intermediate the collars 3A and 3B. A disk 31 is secured to a rotatably driven shaft 32 and is rotatable therewith. The disk has a cam member 31A thereon engageable with the protuberance 3D on the strike bolt 3 to effect, during a rotation of the disk, a lifting of the strike bolt 3 and collar 3A away from the stop 3C. A continued movement of the disk 31 will cause the cam member 31A to become disengaged from the protuberance so that the spring will drive the strike bolt 3 and collar 3A toward the stop 3C. An interpositioning of a workpiece 1 on the table 5 will cause the lower end of the strike bolt 3 to strike the workpiece before the collar 3A strikes the stop 3C. Appropriate adjustment of the strike hammer device 30 will position the strike bolt 3 in the proper position to effect a proper driving thereof by the cam member 3A. Of course, an electromagnetic reciprocal drive for the strike bolt can also be used in place of the aforedescribed mechanical drive. In addition, the frequency of the hammering function can be altered by appropriately varying the rotational speed, for example of the disk 31. To absorb the vibrations, the table 2 of the apparatus can be supported on shock absorbers 9.

To achieve a comparison measurement, it is possible to use, aside from the already described pitch measurement, a special device which is installed in the table 2 according to FIG. 1 and is described with reference to FIG. 3. Same consists of a U-shaped bent glass tube 6, which is partially filled with a colored liquid 60. One end 66 of the glass tube is sealed off air-tight, the other end 67 is connected to an air supply pipe 7. The pipe 7 extends from a pressure source 70 through a throttle valve 75 to a T-like junction 73. One branch of the pipe 7 extends from the junction 73 through a safety valve 76 to the glass tube 6, the other branch to a nozzle 72 in the table 2. A plurality of nozzles are, as sketched in FIG. 1, arranged in a straight line in the table and the nozzle openings are provided at a level flush with the table surface. Each air nozzle 72 has a measuring tube 6 associated therewith.

If now the workpiece does not rest flat on the table 2, then air can escape through the air gap 71 between the workpiece 1 and the outlet end of the nozzle. The relative measurement takes place as follows: The pipe 7 is fed from the pressure source 70 with a gas pressure of approximately 1 bar. The pressure is lowered to approximately 0.5 bar. through the throttle valve 77. If the air gap 71 between workpiece 1 and table 2 is practically zero, then little or no air will escape from the nozzle 72. Thus, an accumulation of the compressed air will occur and this accumulation pressure acts onto the fluid 60 in the glass tube 6. The enclosed gas in the glass tube end 66, or left branch thereof, is compressed and the fluid level is urged lower in the right branch of the glass tube 6.

If the workpiece has a curvature, then greater air gaps 71 are formed above the further outlying nozzles, from which air gaps 71 air will escape. The measuring pressure in the tube end 67 drops, which causes the fluid level in said tube part to be raised. The different levels of the fluid 60 of adjacent glass tubes 6 provides a comparison measurement involving the deviation of the bearing plane of the workpiece from the bearing plane of the table 2.

FIG. 1 shows in the table 2 a plurality of air nozzles 72 and above the workpiece the associated measuring tubes 6 with the measuring fluid 60 therein. From a comparison of the level of the measuring fluid, one can read immediately the nature of the curvature.

For reworking, the workpiece 1 is placed in such a manner on the table, that it can be struck along its inner side of curvature by the strike bolt. Subsequently a series of blows is released while the workpiece is moved slowly laterally from the center. The workpiece is gradually straightened out. One of the already described comparison measurements may simultaneously occur.

Depending on the curvature, material and outer dimensions of the workpiece, number of striking blows, strike strength and radius of curvature of the tip of the strike bolt, the type of strikes must be chosen. The choice is best made based on experience, which, however, can be quickly determined, because comparison measurements can be quickly and easily made after each series of strikes.

Some guide lines forming practical examples are given hereinbelow. The test material is a hardened Amutit S 62 Rc-bar of rectangular cross section having a length of 12.5 cm. and a curvature error of 0.3 mm. Reworking was performed until the curvature error fell to below 0.03 mm. Each five of the same rods were worked with increasing striking forces, wherein, however, the striking force selection occurred empirically. Work was done with a series of approximately 150 strikes and a frequency of 50 strikes per second and a control measurement occurred after each series.

| Dimension in mm. | Radius of the strike bolt tip in mm. | Remaining impression depth on workpiece approximate mm. | Time used including control time in sec. |
|---|---|---|---|
| Example 1 | | | |
| 12.5 × 26 | 2 | 0.012 | 55 |
| | | 0.016 | 45 |
| | | 0.024 | 30 |
| | | 0.030 | 25 |
| | | 0.034 | 22 |
| | | 0.036 | 20 |
| Example 2 | | | |
| 12.5× 26 | 3 | 0.007 | 60 |
| | | 0.012 | 52 |
| | | 0.015 | 45 |
| | | 0.018 | 32 |
| | | 0.025 | 28 |
| | | 0.028 | 25 |
| Example 3 | | | |
| 12.5 × 26 | 4 | 0.006 | 68 |
| | | 0.012 | 57 |
| | | 0.015 | 50 |
| | | 0.018 | 42 |
| | | 0.020 | 36 |
| | | 0.022 | 32 |
| Example 4 | | | |
| 12.5 × 26 | 5 | 0.007 | 80 |
| | | 0.010 | 70 |
| | | 0.012 | 60 |
| | | 0.014 | 50 |
| | | 0.015 | 45 |
| | | 0.016 | 42 |
| Example 5 | | | |
| 8 × 14 | 2 | 0.012 | 40 |
| | | 0.016 | 33 |
| | | 0.024 | 28 |
| | | 0.030 | 22 |
| | | 0.034 | 18 |
| | | 0.036 | 16 |
| Example 6 | | | |
| 8 × 14 | 5 | 0.007 | 70 |
| | | 0.010 | 58 |
| | | 0.012 | 47 |
| | | 0.014 | 38 |
| | | 0.015 | 33 |
| | | 0.016 | 30 |

Examples 1 and 5 can be compared with roughing the finish, Example 3 with finishing and Examples 4 and 6 with fine finishing.

It is shown that the greater radius of the tip of the strike bolt, which varies between 2 and 6 mm., a longer working time is required; however, the surface impressions become smaller. The same result is obtained when the striking force is reduced. The striking force corresponds approximately with a strike which is performed by hand. It may by no means result in a destruction of the workpiece.

Figure 5:
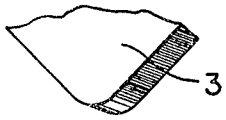

The strike bolt has a curved point and thus may be provided with a ball at its tip as in FIG. 4, or it may have a circular-cylindrical shape as in FIG. 5, so that the blow does not occur at a point but along a line.

Feeding, removing, locking and unlocking of the strike hammer with the strike bolt can be done pneumatically. The strength of the striking force, the number of strikes and the duration of the striking process can be controlled electronically.

The described working will facilitate the production of the workpiece with a minimum of additional finish working required. The amount of finish working can possibly be totally omitted, in particular if the surface quality permits certain slight impressions. Shaft pieces and flat pieces can be reworked.

It is also possible to use as measuring instruments hair rulers or dial gauges. The described comparison measurement has the advantage that the striking process can be interrupted at any time and the shape of the workpiece can be controlled. If one time too much striking takes place, the workpiece can be rotated or turned over and the opposite side worked.

During the verifying measurement of the workpieces, it has been found that the hardness of the piece amounted to 64–67 Rc. after the strike working, which is an improvement over the original harndess of 62 Rc.

With the described method and apparatus, it is possible to expediently rework in quantity elongated pieces and, since the work can be done by auxiliary personnel, the piece can be reworked inexpensively. Waste does not occur. Striking force, strike number and frequency can be changed automatically by using conventional strike hammers and mounting.

Tests have shown that the material deforms progressively in a fluid-like manner, when the strikes are applied with a higher frequency than for example during hammering by hand. Suitable is a strike frequency of 50 to 120 per second. Also the group-wise application of strikes increases the straightening process. Suitable groupings are a series of 30 to 600 strikes, preferably 60 to 350 strikes, and the strikes do not occur locally, but decreasingly from the center of the curvature outwardly away therefrom. A caressing of the workpiece is essentially achieved.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Apparatus for reworking of elongate workpieces, comprising:

an upstanding column;

a strike hammer device movably and adjustably arranged on said column and including at least one strike bolt having a curved point and movable with said strike hammer device for rapidly and repetitively striking a workpiece;

a rigid comparison measuring table for supporting the workpiece in the path of the strike bolt, said table including at least one backing surface for supporting the workpiece and against which the workpiece is to be deformed by repetitive striking of the workpiece by said strike bolt, said backing surface corresponding to the undistorted shape of the workpiece, means defining a plurality of air channels discharging through said backing surface, said air channels opening through said backing surface in an aligned manner and at substantially equal distances from each other, means for maintaining each air channel under pneumatic pressure and indicating devices connected to said air channels to indicate the air pressure drop as air exits from the respective channels.

2. The apparatus of claim 1, including a U-shaped bent tube connected to each air channel, said tubes being filled partially with a colored liquid, one end of each tube being enclosed off air-tight and the other end being connected to the respective one of said air channels intermediate said pneumatic pressure maintaining means and the outlet of said air channel at said workpiece engageable surface.

3. The apparatus of claim 1, including motor means actuable for moving said strike bolt into engagement with said workpiece at a frequency of 50 to 120 strikes per second and for performing strikes in groups of 30 to 600 strikes.

4. The apparatus of claim 3, wherein the strike bolt is exchangeable and has a ball point preferably with a radius of between 2 to 6 mm.

5. The apparatus of claim 3, wherein said table is a flat plate.

6. The apparatus of claim 3, in which said table has a pair of flat backing surfaces defining a V-shaped groove and wherein said workpiece is a shaft placeable in said groove.

7. A method for reworking of metal workpieces to reduce distortion thereof, comprising:

supporting a distorted workpiece on a measurement table having at least one work support surface having the shape of the undistorted workpiece and with said distorted workpiece facing concavely upward from said table;

applying air under pressure to channels to said table and permitting such air to flow out of said channels through nozzles opening through the surface of said table beneath said workpiece and limiting the airflow out each nozzle by the proximity thereto of the opposed surface of the workpiece;

repetitively striking the surface of said workpiece facing away from said nozzles with a strike bolt moved substantially toward said nozzles;

varying the location at which said strike bolt strikes the workpiece to reduce the distance between the under surface of the workpiece and the opposed nozzles by monitoring the relative air pressure in said air channels, so as to conform the under side of said workpiece with said table.

8. Apparatus for reworking of elongate workpieces, comprising:

an upstanding column;

a strike hammer device movably and adjustably arranged on said column and including at least one strike bolt having a curved point and movable with said strike hammer device for rapidly and repetitively striking a workpiece;

a rigid table for supporting the workpiece in the path of said strike bolt, said table having at least one flat surface supporting said workpiece, said table incorporating means for comparison measuring the remaining distortion in the workpiece.

* * * * *

UNITED STATES PATENT OFFICE

CERTIFICATE OF CORRECTION

Patent No. 4 226 111 Dated October 7, 1980

Inventor(s) Marcel Wahli

It is certified that error appears in the above-identified patent and that said Letters Patent are hereby corrected as shown below:

Column 6, line 21; change "Claim 1" to ---Claim 2---.

Column 6, line 42; change "to said table" to ---in said table---.

Signed and Sealed this

Tenth Day of February 1981

[SEAL]

Attest:

RENE D. TEGTMEYER

Attesting Officer

Acting Commissioner of Patents and Trademarks